US005896713A

United States Patent [19]

Chao et al.

[11] Patent Number: 5,896,713

[45] Date of Patent: Apr. 27, 1999

[54] TUBULAR SKYLIGHT WITH VERTICALLY ADJUSTABLE TUBE AND IMPROVED ROOF COVER SEAL

[75] Inventors: Bing-Ling Chao, San Diego; David W. Rillie, Del Mar; Joseph W. Prenn, San Diego; Christian P. Stevens, Carlsbad, all of Calif.

[73] Assignee: Solatube International, Inc., Carlsbad, Calif.

[21] Appl. No.: 08/969,923

[22] Filed: Nov. 13, 1997

[51] Int. Cl.[6] ..... E04D 13/03

[52] U.S. Cl. ..... 52/200

[58] Field of Search ..... 52/200

[56] References Cited

U.S. PATENT DOCUMENTS

| | | |
|---|---|---|
| D. 382,347 | 8/1997 | Grubb . |
| 5,099,622 | 3/1992 | Sutton . |
| 5,467,564 | 11/1995 | DeKeyser et al. . |
| 5,493,824 | 2/1996 | Webster et al. . |
| 5,546,712 | 8/1996 | Bixby . |
| 5,596,848 | 1/1997 | Lynch . |
| 5,648,873 | 7/1997 | Jaster et al. . |
| 5,655,339 | 8/1997 | DeBlock et al. . |

OTHER PUBLICATIONS

Capturing Renewable Energy Making It Happen! 3M Austin Ctr. Solar Optical Products, 3M Optics Technology Development. 3M Center Bldg.225–2N–06, St. Paul, MN 55144–1000, 1996.

Daylighting Panels. Solar Optical Products, 3M Optics Technology Development. 3M Center Bldg.225–2N–06, St. Paul, MN 55144–1000, 1996.

Sanyo Solar Daylighting System. Sanyo Electric Co.Ltd., Air–Conditioning & Refrigeration, R & D Center, 1995.

*Primary Examiner*—Christopher Kent

*Attorney, Agent, or Firm*—John L. Rogitz

[57] ABSTRACT

A tubular skylight is supported in a building between the ceiling and the roof of the building by a support ring that is connected to the ceiling joists or to the ceiling dry wall. Specifically, a tube ring is engaged with the tube of the skylight to in turn engage the support ring and thereby support the tube. Also, the skylight includes a cover seal that establishes a seal between the roof dome of the skylight and the tube, and that also spaces the flashing of the skylight from the tube to prevent galvanic corrosion and to inhibit heat transfer between the flashing and the tube. The tube includes an upper segment that receives a lower segment, and an expansion seal is positioned between the segments such that the segments can move relative to each other to absorb thermal stresses, with the expansion seal maintaining a seal between the segments.

21 Claims, 4 Drawing Sheets

TUBULAR SKYLIGHT WITH VERTICALLY ADJUSTABLE TUBE AND IMPROVED ROOF COVER SEAL

FIELD OF THE INVENTION

The present invention relates generally to apparatus for naturally illuminating rooms, and more particularly to tubular skylights.

BACKGROUND

Tubular skylights have been provided for illuminating rooms inside buildings with natural light. Not only do tubular skylights thus save electricity and, concomitantly, are environmentally benign, but they illuminate rooms in a pleasing way using natural sunlight instead of 60 cycle electric light. An example of a commercially successful tubular skylight is disclosed in U.S. Pat. No. 5,099,622, assigned to the same assignee as the present invention and incorporated herein by reference.

A tubular skylight includes a roof-mounted, dome-like transparent cover. The cover is mounted on the roof of a building by means of a flashing. An internally reflective tube depends downwardly from the roof to the ceiling of the room sought to be illuminated, and the bottom of the tube is covered with a light diffuser that is positioned at the ceiling.

In most existing tubular skylights, the ceiling dry wall supports the diffuser and the tube. This is so in part because existing tubular skylights are not designed to be installed during construction of the building, but rather are retrofitted into the building after construction, when the ceiling dry wall has been attached to the ceiling joists and, hence, when access to the void between the roof and ceiling may not be possible. In other words, the only practical way to mount the diffuser and lower end of the tube in many circumstances is to attach the tube to the ceiling dry wall, instead of to relatively sturdier but inaccessible ceiling joists above the dry wall. Accordingly, to install a tubular skylight, a hole must be cut in the existing ceiling dry wall and in the roof, and then the skylight positioned and mounted as described above.

While effective for retrofitting skylights into existing homes, the above-described installation technique is unacceptable in the context of new home construction. This is because many municipal codes require inspection of structures between the roof and ceiling. As intimated above, however, once the ceiling dry wall is attached to the ceiling joists, such inspection might be impractical to undertake. The present invention, however, recognizes that it is possible to provide a skylight that conveniently can be installed during new home construction to permit inspection of the skylight before the ceiling dry wall is installed.

Additionally, the present invention recognizes and addresses several other considerations in tubular skylight design. One such consideration is that both the diffuser and the cover be effectively sealed to the tube. Otherwise, water vapor can enter the tube and condense, thereby reducing the illuminating capability of the skylight. As recognized by the present invention, however, many existing cover seals are rendered ineffective because the tube tends to warp over time, thereby spacing the seal from either the tube or the cover.

Furthermore, it is desirable not only to provide an effective seal between the cover and the upper end of the tube, but it is also desirable to maintain a predetermined space between the flashing and the tube. This is because the flashing can be made from a metal that is different from the metal of the tube, and if the two dissimilar metals come into contact with each other, galvanic corrosion undesirably can be induced. In addition, providing a thermal barrier between the flashing and the tube is desirable to reduce heat transfer between the flashing and tube and, thus, to reduce the amount of energy required to heat or cool the building. As recognized by the present invention, both an effective seal and a spacer can be provided using a single component.

Still further, the present invention recognizes that thermal stress can cause the tube to move relative to the building, and that such movement can further reduce the integrity of the skylight assembly. And, the present invention understands that it might be desirable that a tube of a skylight be vertically adjustable relative to the building to facilitate installation of the skylight.

Accordingly, it is an object of the present invention to provide a tubular skylight that can be installed in a building during construction of the building. Another object of the present invention is to provide a tubular skylight that incorporates an effective seal between the roof cover and the tube, and that maintains a space between a roof flashing and the tube to reduce galvanic corrosion. Still another object of the present invention is to provide a tubular skylight that absorbs thermal stress. Yet another object of the present invention is to provide a tubular skylight that can be vertically adjusted relative to a building after the tube of the skylight has been attached to the building, to facilitate installation of the skylight. Another object of the present invention is to provide a tubular skylight that is easy to use and cost-effective to manufacture.

SUMMARY OF THE INVENTION

A tubular skylight is disclosed for a building having a roof with a skylight flashing and at least one ceiling joist below the roof for supporting a ceiling above a room. The skylight includes a transparent cover that is engageable with the flashing. A tube assembly depends downwardly from the flashing and has an upper end covered by the cover. Also, a support ring is engageable with the ceiling joist or the ceiling, with the support ring receiving the tube assembly therein to support the tube assembly. Additionally, a light diffuser assembly is juxtaposable with the ceiling for covering a lower opening of the tube assembly and for directing light therefrom into the room.

In the preferred embodiment, the tube assembly includes an upper tube segment and a lower tube segment, and an expansion seal is positioned radially between the segments to permit longitudinal relative motion between the segments. In this way, thermal stress is absorbed by the tube assembly.

Further, a tube ring is surroundingly engaged with the tube assembly for engaging the support ring. Preferably, the support ring defines an upper edge and a lower edge, and the tube ring includes at least one tab member including an upper tab for engaging the upper edge. Also, the tab member includes a lower tab for engaging the lower edge of the support ring. Moreover, the tube ring includes a ring body, the tab member is engaged with the ring body, and an adjustment member is engaged with the tab member for selectively moving the tab member axially relative to the ring body. To hold the diffuser assembly onto the tube assembly, the tube ring includes at least one clip receiver, and the diffuser assembly includes a diffuser frame and at least one spring clip connected thereto for engaging the clip receiver.

As provided herein, a cover seal surroundingly engages the tube assembly radially between the cover and the tube assembly to establish a seal between the cover and the tube assembly. Advantageously, the cover seal is formed with at least one cover wiper surface for contacting an inner surface of the cover. Also, the cover seal is formed with at least one tube wiper surface for contacting an outer surface of the tube assembly. Moreover, the cover seal defines a flashing channel between the wiper surfaces for receiving an upper edge of the flashing therein. With this structure, a seal is established between the cover and the tube to prevent moisture and debris from entering the tube and deleteriously effecting the light transmission properties thereof. Also, the flashing is maintained in a spaced relationship to the tube to prevent galvanic corrosion, and to establish a thermal break or barrier between the flashing and tube.

In another aspect, a tubular skylight for a building having a roof with a skylight flashing includes a cover engageable with the flashing and a tube assembly depending downwardly from the flashing and having an upper end covered by the cover. Also, the skylight includes a cover seal surroundingly engaged with the tube assembly and positioned radially between the cover and the tube assembly to establish a seal between the cover and the tube assembly. A light diffuser assembly covers a lower opening of the tube assembly for directing light outwardly therefrom.

In still another aspect, a method for mounting a tubular skylight in a building having a roof and at least one ceiling joist below the roof includes attaching a skylight support to the ceiling joist. Then, the method includes engaging the tubular skylight with at least the skylight support. After the tubular skylight is engaged with the building, a ceiling is attached to the at least one ceiling joist.

In another aspect of the present invention, a tubular skylight is disclosed for a building having a roof with a skylight flashing and at least one ceiling joist below the roof for supporting a ceiling above a room. The skylight includes a transparent cover engageable with the flashing and a tube assembly depending downwardly from the flashing, the upper end of the tube assembly being covered by the cover. A light diffuser assembly is juxtaposable with the ceiling for covering a lower opening of the tube assembly and for directing light therefrom into the room. In accordance with the present invention, at least a portion of the tube assembly is vertically adjustable relative to the ceiling joist when the tube assembly is installed in the building.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
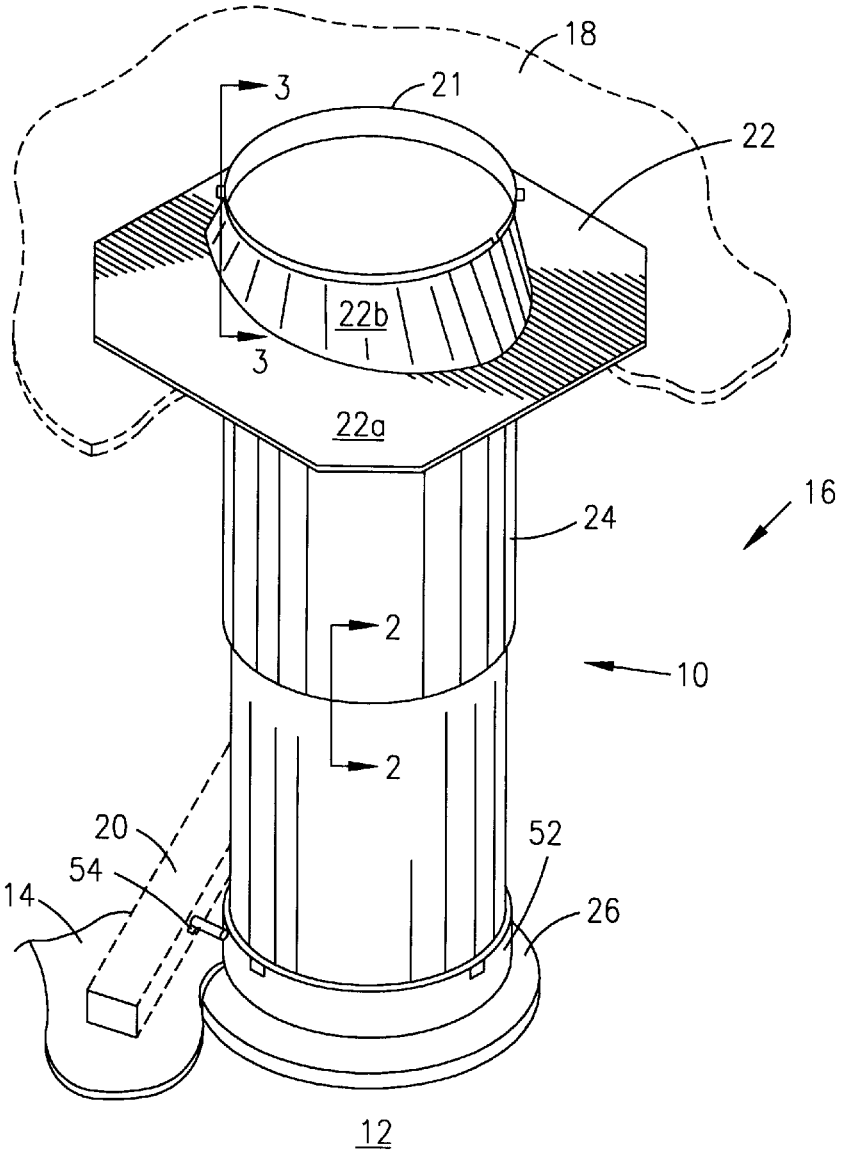
FIG. 1 is a perspective view of the tubular skylight of the present invention, with cut-away portions of the roof and ceiling joist shown in phantom, and with portions of the ceiling cut away.

Referring initially to FIG. 1, a tubular skylight is shown, generally designated 10, for lighting, with natural sunlight, an interior room 12 having a ceiling dry wall 14 in a building, generally designated 16. FIG. 1 shows that the building 16 has a roof 18 and one or more ceiling joists 20 that support the ceiling dry wall 14.

As shown in FIG. 1, the skylight 10 includes a roof-mounted cover 21. The cover 21 is optically transmissive and preferably is transparent. In one embodiment, the cover 21 can be the cover disclosed in co-pending U.S. patent application Ser. No. 08/957,153 filed Oct. 24, 1997 for an invention entitled "LIGHT-COLLECTING SKYLIGHT COVER", owned by the same assignee as the present invention. Or, the cover 21 can be other suitable covers, such as the covers marketed under the trade name "Solatube" by the present assignee.

The cover 21 is mounted to the roof 18 by means of a flashing 22. The flashing 22 includes a flange 22*a* that is attached to the roof 18 by means well-known in the art, and a curb 22*b* rises upwardly from the flange 22*a* and is angled relative to the flange 22*a* as appropriate for the cant of the roof 18 to engage and hold the cover 21 in the generally vertically upright orientation shown.

As further shown in FIG. 1, an internally reflective metal tube assembly 24 is connected to the flashing 22. The tube assembly 24 extends to the ceiling 14 of the interior room 12. Per the present invention, the tube assembly 24 directs light that enters the tube assembly 24 downwardly to a light diffuser assembly 26, in the room 12. The tube assembly 24 can be made of a metal such as a type 1150 alloy aluminum, or the tube assembly 24 can be made of fiber or plastic or other appropriate material, with the interior of the tube assembly 24 being rendered reflective by means of, e.g., electroplating, anodizing, metalized plastic film coating, or other suitable means. In one preferred embodiment, the light diffuser assembly 26, tube assembly 24, and flashing 22 are made by the present assignee.

Figure 2:
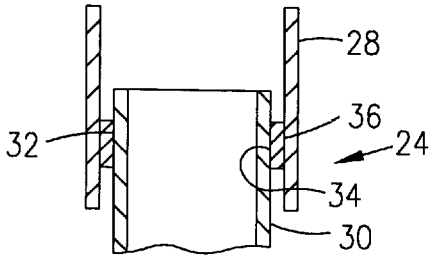
FIG. 2 is a cross-sectional view showing the expansion seal between the upper and lower tube segments, as seen along the line 2—2 in FIG. 1.

FIG. 2 shows the details of the preferred tube assembly 24. As can be appreciated in reference to FIG. 2, the tube assembly 24 includes a cylindrical hollow upper tube segment 28 and a cylindrical hollow lower tube segment 30 that is slidably disposed in the upper segment 28. Accordingly, the segments 28, 30 can move axially relative to each other to absorb thermal stresses.

As intended by the present invention, an expansion seal 32 is positioned radially between the segments 28, 30 to permit longitudinal (i.e., axial) relative motion between the segments 28, 30, while establishing a seal between the segments 28, 30. In the preferred embodiment, the expansion seal 32 includes a fabric surface 34 that is oriented radially inwardly, i.e., against the surface of the lower tube segment 30. Opposite the felt surface 34 is a felt surface 36 that is oriented radially outwardly, i.e., against the surface of the upper tube segment 28. It is to be understood that the upper tube segment 28 alternatively can be received within the inner tube segment 30 if desired.

Figure 3:
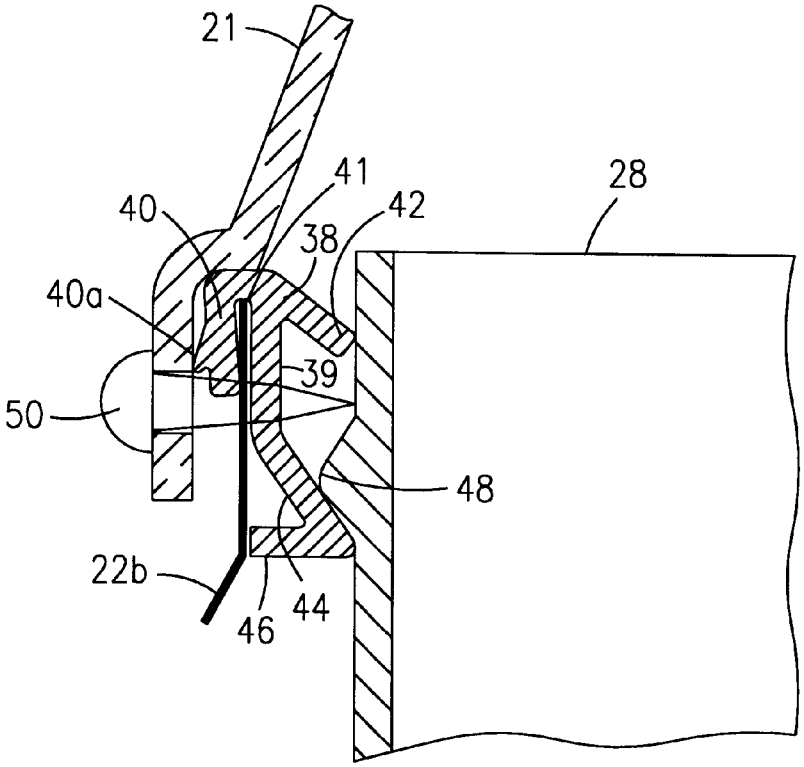
FIG. 3 is a cross-sectional view showing the cooperation between the roof cover, cover seal, flashing, and upper tube segment, as seen along the line 3—3 in FIG. 1, with the fastener shown in phantom.
Figure 4:
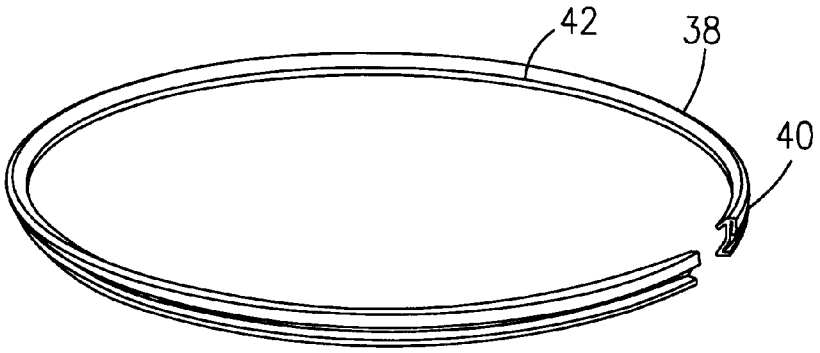
FIG. 4 is a perspective view of the cover seal.

FIGS. 3 and 4 show the present inventive combination for establishing a seal between the tube assembly 24 and cover 21, for establishing a predetermined space between the dissimilar metals of the flashing 22 and tube assembly 24, and for holding the cover 21, flashing 22, and tube assembly 24 securely together while protecting the upper edge of the flashing 22. In the embodiment shown, a resilient rubber or plastic cover seal 38 is surroundingly engaged with the tube assembly 24 and is positioned radially between the cover 21 and the tube assembly 24. It can readily be appreciated in reference to FIG. 3 that the cover seal 38 establishes a seal between the cover 21 and the tube assembly 24.

In the presently preferred embodiment, the cover seal 38 is formed with a generally vertically-oriented ring-shaped body 39 and a ring-shaped cover arm 40 that is concentric with the body 39. A U-shaped flashing channel 41 is established between the cover arm 40 and body 39. Also, as shown best in FIG. 3, the cover arm 40 defines a wiper surface 40*a* that protrudes radially outwardly toward the cover 21 to abut the inner surface of the cover 21.

Additionally, the cover seal 38 is formed with a tube wiper arm 42 that protrudes radially inwardly from the upper end of the body 39 toward the tube assembly 24 to contact the outer surface of the tube assembly 24. Furthermore, the generally vertically-oriented body 39 includes a lower segment 44 that doglegs radially inwardly as shown, and a horizontally-oriented flashing wiper arm 46 extends outwardly from the lower end of the lower segment 44.

With the above disclosure in mind, the cooperation of structure for sealing the cover 21 can now be appreciated. FIG. 3 shows that the upper tube segment 28 is radially formed with a lip 48, and the cover seal 38 is positioned around the upper tube segment 28 with the lower segment 44 of the body 39 extending below the lip 48 and with the tube wiper arm 42 contacting the upper tube segment 28 at a point above the lip 48. Also, the flashing channel 41 of the cover seal 38 receives an upper cylindrical portion of the flashing curb 22*b* as shown. Next, the cover 21 is positioned over the upper tube segment 28, with the cover 21 riding against the cover wiper surface 40*a* to slightly deform the cover arm 40. In this way, the cover seal 38 essentially interlockingly engages the cover 21, tube assembly 24, and flashing 22.

Owing to the material resiliency of the cover seal 38 and to the above-described cooperation of structure, including the clearances that result in slightly compressing the cover seal 38, the skilled artisan will appreciate that a seal is established between the cover 21 and the tube assembly 24, with the seal retaining its effectiveness even should the tube assembly 24 undergo some radial warpage. Moreover, the flashing wiper arm 46 in cooperation with the flashing channel 41 establishes a predetermined space between the flashing curb 22*b* and the upper tube segment 28 to prevent galvanic corrosion and to inhibit heat transfer between the flashing 22 and the tube assembly 24. Still further, the upper edge of the flashing curb 22*b* is enclosed in the flashing channel 41 as shown to protect the upper edge of the flashing. As can be readily appreciated, the above functions advantageously are all performed by a single unitarily-made component, namely, the cover seal 38. If desired, one or more fasteners 50 can be inserted through the cover 21, flashing 22, and seal 38 as shown to enhance the engagement of the cover 21 with the above-described structure.

Figure 5:
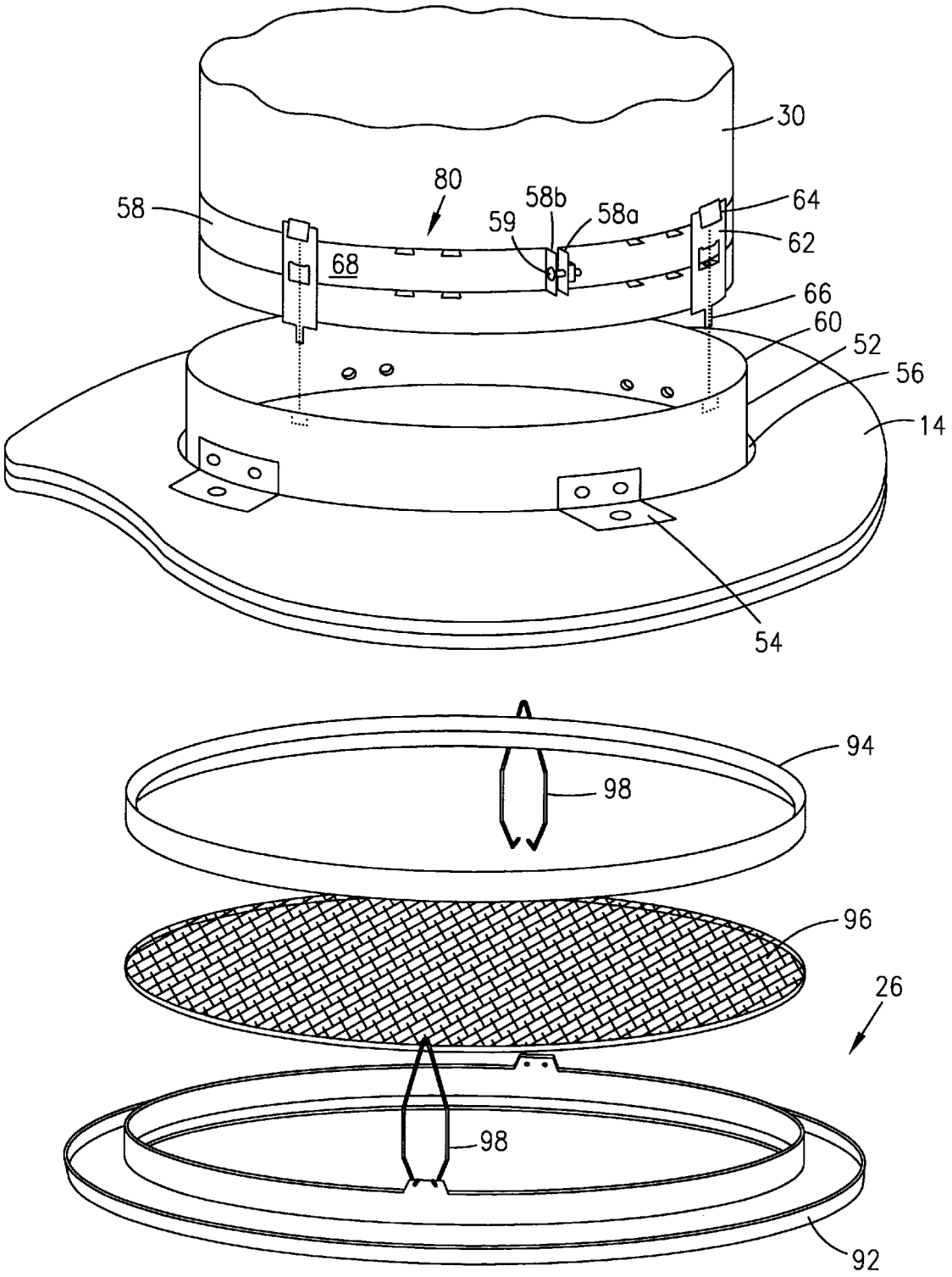
FIG. 5 is an exploded perspective view showing the cooperation between the lower tube segment, tube ring, support ring, and diffuser assembly, in an embodiment in which the support ring is attached to the ceiling dry wall, with portions of the ceiling broken away.
Figure 6:
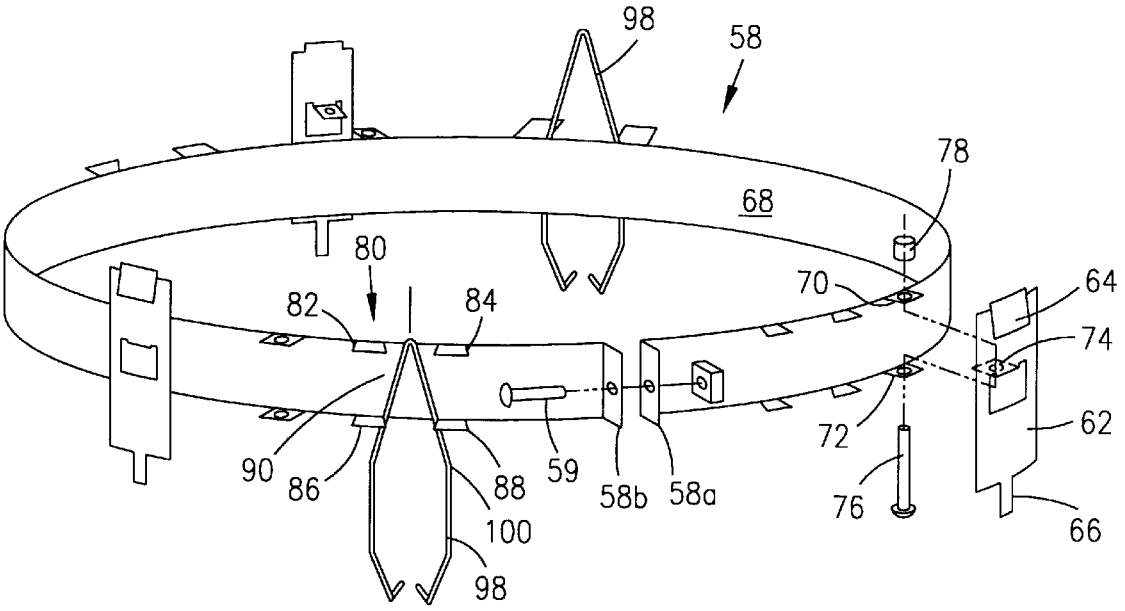
FIG. 6 is an exploded perspective view of the tube ring.

Now referring to FIGS. 5 and 6, the cooperation between the diffuser assembly 26 and the lower tube segment 30 of the tube assembly 24 can be appreciated. As shown in FIG. 5, a cylindrical metal support ring 52 is engaged via brackets 54 preferably with one or more ceiling joists 20 (FIG. 1) or with the ceiling dry wall 14 (FIG. 5). For new construction applications, the support ring 52 preferably is connected to the ceiling joists 20 prior to attaching the ceiling dry wall 14 to the joists 20, although FIG. 5 shows, for illustration purposes, that the support ring 52 can, if desired, be attached to the dry wall 14 as might done, for example, in retrofitting applications. For new construction applications, however, the support ring 52 is first attached to the joists 20 (and the tubular skylight 10 installed and inspected as discussed below), and then the ceiling dry wall 14 is attached to the joists 20. A hole 56 is formed in the dry wall 14, and the hole 56 is coaxial with the support tube 52 and has a diameter that is marginally larger than the diameter of the support ring 52.

As mentioned above, prior to installing the dry wall 14 and after the support ring 52 is attached to the joists 20, the tubular skylight is installed in the building 16. Specifically, the lower tube segment 30 is received in the support ring 52, and a cylindrical metal tube ring 58 surroundingly engages the lower tube segment 30 for engaging the support ring 52. Opposed ends 58*a*, 58*b* of the tube ring 58 can be held together by a threaded fastener 59.

In the preferred embodiment shown, the support ring 52 defines an upper edge 60 and a lower edge (not shown in FIG. 5), and the tube ring 58 includes at least one and preferably plural flat, generally parallelepiped-shaped metal tab members 62 that in turn include respective upper tabs 64 which are bent downwardly for engaging the upper edge 60. As also shown in FIGS. 5 and 6, the tab member 62 includes a manually bendable lower tab 66 that can be bent upwardly, once the upper tab 64 engages the upper edge 60 of the support ring 52, to engage the lower edge of the support ring 52. In this way, each tab member 62 is held onto the support ring 52.

According to the present invention, the tube ring 58 includes a cylindrical ring body 68, and the tab members 62 are reciprocatingly engaged with the ring body 68 for axial relative movement thereto. In the presently preferred embodiment, as best shown in FIG. 6, for each tab member 58, the ring body 68 includes upper and lower eyes 70, 72, and the tab member 58 includes a tab eye 74. An adjustment member, preferably a threaded fastener 76, extends through the eyes 70, 72, 74 and is threadably engaged with a nut 78 that is affixed to the upper eye 70.

The skilled artisan can now readily appreciate that with the tab member 62 engaged with the support ring 52 as described, the fasteners 76 can be manipulated for selectively moving the ring body 68 axially relative to the respective tab member 62. For example, during installation it might be desired to move the lower tube assembly upwardly to install the dry wall 14, and a person in the room 12 accordingly can advance a screwdriver upwardly to serially engage the fasteners 76 and thereby incrementally move the lower tube segment 30 up relative to the support ring 52. Once the dry wall 14 is installed, the person can advance the screwdriver through the clearance area of the hole 56 between the dry wall 14 and the support ring 52 and manipulate the fasteners 76 to lower the lower tube segment 30 back down again, such that the lower edge of the support ring 52 is more or less flush with the dry wall 14. Then, the diffuser assembly 26 can be engaged with the tube assembly 24 as described below.

FIGS. 5 and 6 show that the tube ring body 68 is formed with plural clip receivers 80. As shown best in FIG. 6, each clip receiver 80 includes opposed spaced apart left and right upper clip tabs 82, 84 that extend radially outwardly from the upper edge of the ring body 68. Also, each clip receiver 80 includes opposed spaced apart left and right lower clip tabs 86, 88 that extend radially outwardly from the lower edge of the ring body 68, with a clip channel 90 being established between the clip tabs 82, 84, 86, 88.

In cross-reference to FIGS. 5 and 6, in one embodiment the diffuser assembly 26 includes a plastic ring-shaped diffuser frame 92, a resilient ring-shaped diffuser gasket 94, and a light diffuser pane 96 that is sandwiched between the frame 92 and the gasket 94. Plural spring clips 98 are connected to the frame 92 as shown. With the lower tube segment 30 in place, the diffuser assembly 26 is lifted upwardly to advance each clip 98 into a respective clip channel 90 of the tube ring 58. As the clips are advanced into their channels 90, the clips 98 are deformed as they ride through the channels 90 until the widest portions 100 of the clips 98 clear the respective sower clip tabs 86, 88. Then, the material resiliency of the clips 98 causes the clips 98 to expand outwardly in the respective clip channel 90 to engage the respective clip tabs 82, 84, 86, 88 and thereby hold the diffuser assembly 26 onto the tube assembly 24.

While the particular TUBULAR SKYLIGHT WITH VERTICALLY ADJUSTABLE TUBE AND IMPROVED ROOF COVER SEAL as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more".

What is claimed is:

1. A tubular skylight for a building having a roof and a ceiling above a room, comprising:

a transparent cover mountable on the roof;

a tube assembly configured for depending downwardly from the roof and having an upper end covered by the cover, the tube assembly including an upper tube segment and a lower tube segment;

a support ring engageable with the ceiling, the support ring receiving the tube assembly therein to support the tube assembly;

a light diffuser assembly juxtaposable with the ceiling for covering a lower opening of the tube assembly and for directing light therefrom into the room; and an expansion seal positioned radially between the upper and lower tube segments to permit longitudinal relative motion between the segments.

2. The tubular skylight of claim 1, further comprising a tube ring surroundingly engaged with the tube assembly for engaging the support ring.

3. The tubular skylight of claim 2, wherein the support ring defines an upper edge and a lower edge, and the tube ring includes at least one tab member including an upper tab for engaging the upper edge.

4. The tubular skylight of claim 3, wherein the tab member includes a lower tab for engaging the power edge.

5. The tubular skylight of claim 4, wherein the tube ring includes a ring body and the tab member is engaged with the ring body, and the skylight further comprises an adjustment member engaged with the tab member for selectively moving the tab member axially relative to the ring body.

6. The tubular skylight of claim 1, further comprising a tube ring including at least one clip receiver, wherein the diffuser assembly includes a diffuser frame and at least one spring clip connected thereto for engaging the clip receiver to hold the diffuser assembly onto the tube assembly.

7. The tubular skylight of claim 1, further comprising a cover seal surroundingly engaged with the tube assembly and positioned radially between the cover and the tube assembly to establish a seal between the cover and the tube assembly.

8. The tubular skylight of claim 7, wherein the cover seal is formed with at least one cover wiper surface for contacting an inner surface of the cover, at least one tube wiper surface for contacting an outer surface of the tube assembly, and a flashing channel therebetween for receiving an upper edge of a flashing therein, whereby heat transfer between the flashing and the tube assembly is inhibited.

9. A tubular skylight for a building having a roof, comprising:

a cover engageable with the roof;

a tube assembly configured for depending downwardly from the roof and having an upper end covered by the cover, the tube assembly including an upper tube segment and a lower tube segment;

a cover seal surroundingly engaged with the tube assembly and positioned radially between the cover and the tube assembly to establish a seal between the cover and the tube assembly;

a light diffuser assembly covering a lower opening of the tube assembly for directing light outwardly therefrom; and an expansion seal positioned radially between the upper and lower tube segments to permit longitudinal relative motion between the segments.

10. The tubular skylight of claim 9, wherein the building includes a ceiling above a room, and the skylight further comprises:

a support ring engageable with the ceiling, the support ring receiving the tube assembly therein to support the tube assembly; and a tube ring surroundingly engaged with the tube assembly for engaging the support ring.

11. The tubular skylight of claim 10, wherein the support ring defines an upper edge and a lower edge, and the tube ring includes at least one tab member including an upper tab for engaging the upper edge.

12. The tubular skylight of claim 11, wherein the tab member includes a lower tab for engaging the lower edge.

13. The tubular skylight of claim 11, wherein the tube ring includes a ring body and the tab member is engaged with the ring body, and the skylight further comprises an adjustment member engaged with the tab member for selectively moving the tab member axially relative to the ring body.

14. The tubular skylight of claim 9, further comprising a tube ring including at least one clip receiver, and the diffuser assembly includes a diffuser frame and at least one spring clip connected thereto for engaging the clip receiver to hold the diffuser assembly onto the tube assembly.

15. The tubular skylight of claim 9, wherein the cover seal is formed with at least one cover wiper surface for contacting an inner surface of the cover, at least one tube wiper surface for contacting an outer surface of the tube assembly, and a flashing channel therebetween for receiving an upper edge of a flashing therein, whereby heat transfer between the flashing and the tube assembly is inhibited.

16. A method for mounting a tubular skylight in a building having a roof and at least one ceiling joist below the roof, comprising the steps of:

attaching a support to the at least one ceiling joist;

engaging the tubular skylight with at least the support, the tubular skylight including a tube assembly including an upper segment and a lower segment;

after the tubular skylight is engaged with the building, attaching a ceiling to the at least one ceiling joist; and providing an expansion seal radially between the segments to permit longitudinal relative motion between the segments.

17. The method of claim 16, wherein the support is a support ring, and the method includes providing a tubular skylight including:

a skylight flashing engaged with the roof;

a transparent cover engaged with the flashing;

a tube assembly depending downwardly from the flashing and having an upper end covered by the cover; and a light diffuser assembly for covering a lower opening of the tube assembly and for directing light therefrom into the room.

18. The method of claim 17, wherein the providing step further includes:

providing a tube ring surroundingly engaged with the tube assembly for engaging the support ring, the support ring defining an upper edge and a lower edge, the tube ring including at least one tab member including an upper tab for engaging the upper edge, the tube ring including a ring body, the tab member being engaged with the ring body, the tube ring also including at least one clip receiver, the diffuser assembly including a diffuser frame;

providing at least one spring clip connected to the diffuser frame for engaging the clip receiver to hold the diffuser assembly onto the tube assembly; and providing an adjustment member engaged with the tab member for selectively moving the tab member axially relative to the ring body.

19. The method of claim 14, further comprising the steps of:

surroundingly engaging a cover seal with the tube assembly radially between the cover and the tube assembly to establish a seal between the cover and the tube assembly, the cover seal being formed with at least one cover wiper surface for contacting an inner surface of the cover, at least one tube wiper surface for contacting an outer surface of the tube assembly, and a flashing channel therebetween for receiving an upper edge of a flashing therein, whereby heat transfer between the flashing and the tube assembly is inhibited.

20. A tubular skylight for a building having a roof and a ceiling above a room, comprising:

a transparent cover engageable with the roof;

a tube assembly configured for depending downwardly from the roof and having an upper end covered by the cover, the tube assembly having an upper tube segment and a lower tube segment; p1 a light diffuser assembly juxtaposable with the ceiling for covering a lower opening of the tube assembly and for directing light therefrom into the room; and a support ring engageable with the ceiling, the support ring receiving the tube assembly therein to support the tube assembly, the support ring defining an upper edge and a lower edge; and an expansion seal between the segments to permit longitudinal relative motion between the segments.

21. The tubular skylight of claim 20, further comprising a cover seal surroundingly engaged with the tube assembly and positioned radially between the cover and the tube assembly to establish a seal between a cover and the tube assembly and to inhibit heat transfer between the flashing and the tube assembly.

* * * * *